United States Patent [19]

Gillotti

[11] 4,333,638

[45] Jun. 8, 1982

[54] MASSAGE AND THERAPEUTIC BODY WORK TABLE

[76] Inventor: Michael A. Gillotti, 6979 Baker La., Sebastapol, Calif. 95472

[21] Appl. No.: 215,121

[22] Filed: Dec. 10, 1980

Related U.S. Application Data

[63] Continuation of Ser. No. 26,822, Apr. 4, 1979, abandoned.

[51] Int. Cl.[3] ..... A61G 13/00

[52] U.S. Cl. ..... 269/322; 269/328; 269/902; 108/36

[58] Field of Search ..... 269/322, 327, 328, 321 CF, 269/902; 128/70–74; 108/35–36, 113, 130–132

[56] References Cited

U.S. PATENT DOCUMENTS

| | | | |
|---|---|---|---|
| 131,989 | 10/1872 | Andre et al. | 108/35 |
| 1,062,996 | 5/1913 | Sornberger | 108/36 |
| 2,579,783 | 12/1951 | Branto | 269/322 |
| 3,139,045 | 6/1964 | Rojakovick | 108/144 X |
| 3,878,797 | 4/1975 | Patterson | 108/36 X |

FOREIGN PATENT DOCUMENTS

| | | | |
|---|---|---|---|
| 400752 | 8/1909 | France | 108/36 |
| 1186719 | 11/1956 | France | 269/322 |
| 724050 | 2/1955 | United Kingdom | 108/36 |

*Primary Examiner*—Robert C. Watson
*Attorney, Agent, or Firm*—Melvin R. Stidham

[57] ABSTRACT

A massage and therapeutic body work table consisting of a top rectangular surface divided into two abutting demi-sections with peripheral border flanges, the demi-sections hingedly attached to each other at abutting borders and foldable to a parallel position. Handles are provided for ease in transport. Two pairs of adjustable height legs are hingedly attached at opposite ends of the table surface, the legs foldable into table surface's housing. A truss system provides support with flexible chord members extending between the paired legs parallel to the table surface, and diagonal members extending from each leg to the table surface. The table is provided with a face rest extension inserted into the end of the table surface.

6 Claims, 11 Drawing Figures

MASSAGE AND THERAPEUTIC BODY WORK TABLE

RELATED APPLICATION

This application is a continuation of my co-pending application Ser. No. 26,822; filed Apr. 4, 1979 and now abandoned for Massage and Therapeutic Body Work Table.

BACKGROUND OF THE INVENTION

Because of a growing interest in health, and particularly the reduction of stress as related to health maintenance, there is an increased interest in massage and an increase in therapeutic body work practitioners, both professional and non-professional; thus, there is greater need for a massage and therapeutic body work table.

OBJECTS OF THE INVENTION

The major advantage of this invention over prior art is its simplicity of design. The truss suspension system used in this invention provides an incredibly strong and rigid structure with a minimum of parts. This allows the table to be light weight and portable, and at the same time economically produced.

Another advantage of this invention over other similar tables is that the horizontal height can be changed according to the practitioners' own needs and type of massage or therapeutic body work being done. Thus, practitioners can perform their work with minimum stress to their own bodies. Further, the height adjustment can be made very quickly and easily, and because of a lip and channel adjustable leg system, the table is maximally rigid at all elevations.

Still another advantage of this invention is that a cushioned and upholstered top surface is provided; thus, the need to carry a separate cushioned surface to lay on top of the table is eliminated.

A final advantage of this invention is the face rest extending from the end of the table. Previous tables have provided face holes in the table's surface or one-piece forehead rests. The face rest has the advantage of being adjustable for different sizes of faces, and as a result is much more comfortable than previous headpieces. The face rest also allows the client to breathe easily and to keep his or her neck and spine in perfect alignment with the rest of the body. Further, the face rest extends the overall length of the table to accommodate taller clients with minimal increase in weight and structure.

Finally, this invention provides all the desirable features of a massage and therapeutic body work table: it is strong, rigid, lightweight, and portable; has an adjustable height, an upholstered, cushioned surface, and a face rest to allow maximum comfort and body alignment.

Other objects and advantages of this invention will become apparent from the description to follow particularly when read in conjunction with the accompanying drawing.

SUMMARY OF THE INVENTION

Generally, this massage and therapeutic body work table consists of a top surface of two, abutting demi-sections; two sets of paired, adjustable height legs; a truss support system; and a face rest extension.

The two, abutting demi-sections forming the top surface are comprised of two rigid, rectangular elements with reinforced peripheral border flanges. A cushion may then be attached to the table surface with upholstery or other means. The said demi-sections are attached to each other by a hinge means and may be folded parallel to each other for portability or storage. Handles are provided for ease in transport.

The paired legs are attached to opposite ends of the table surface by hinge means, and each leg is held in parallel position to its paired member by cross braces. Each leg consists of an upper leg member hingedly attached to the table's surface and a lower leg member attached to the upper leg by means of two threaded rods and adjusting nuts. The upper and lower legs are further joined and secured by inserting a lip on the inside surface of the lower leg into a groove along the outside surface of the upper leg. This provides maximum end-to-end rigidity at all elevations. The lower leg is provided with several openings so that the height of the table can be easily altered by inserting the lower leg into the upper leg's threaded rods at higher or lower openings.

The table's strength and rigidity are provided by a truss support system comprised of a chord member of wire rope or other flexible material attached to the lower end of the upper legs, and extending the full length of the table, parallel to the table surface. The diagonal members extend from the lower end of each upper leg to the center of the table surface, and are removable to allow the paired legs to fold into the housing formed by the table surface and border flanges.

The face rest consists of three cushions mounted on a flat plate. Said flat plate is provided with rods which extend past the surface of the flat plate and insert through openings in the peripheral border flanges at one end of the table, thus providing an extension off the end of the table. One of the three cushions supports the forehead, and the other two support the face. The face cushions are movable to a wider or shorter distance to each other to accommodate larger or smaller faces.

DESCRIPTION OF A PREFERRED EMBODIMENT

Figure 1:
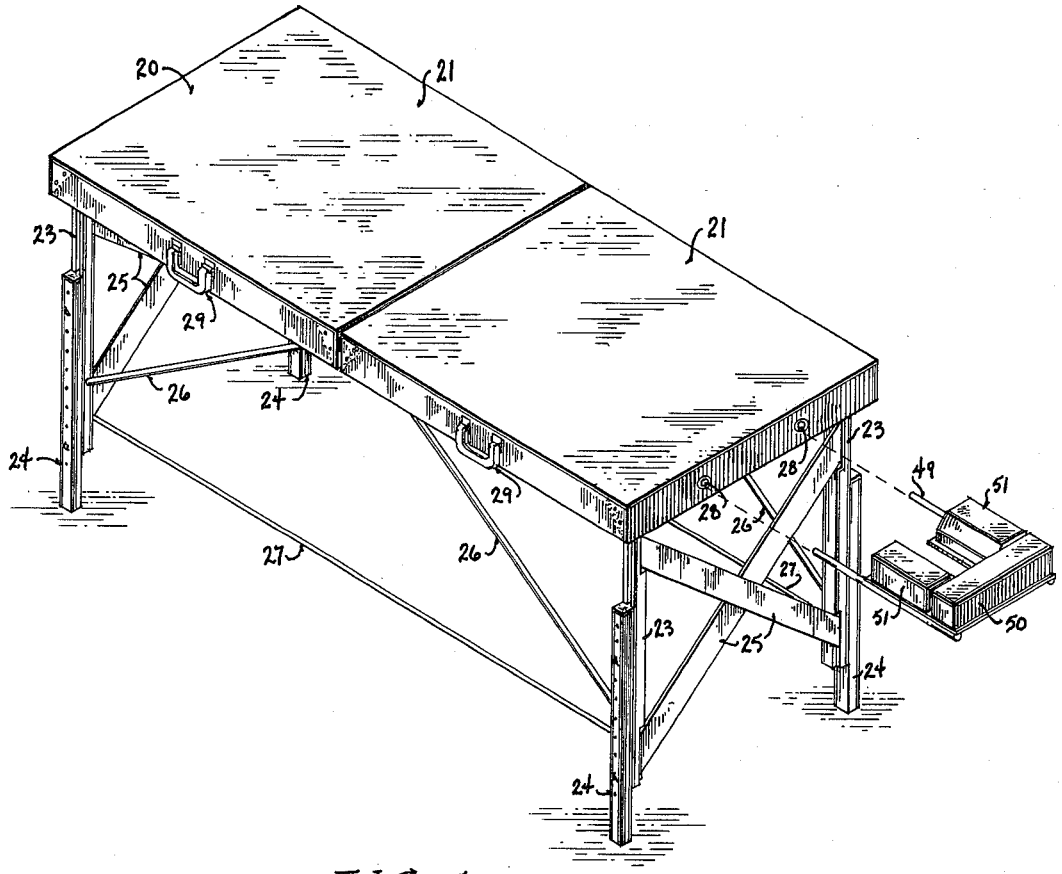
FIG. 1 is a perspective view of the massage and therapeutic body work table in assembled position, including face rest extension.
Figure 2:
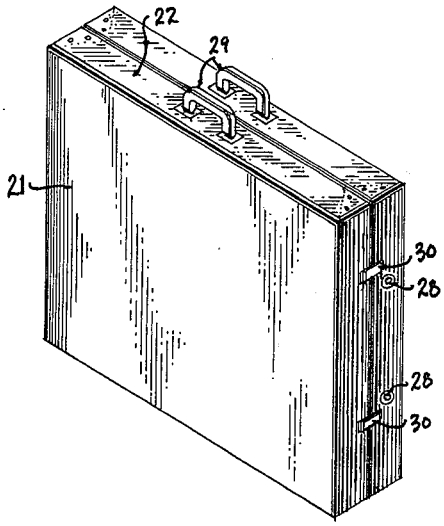
FIG. 2 is a perspective view of the table in disassembled, transportable position.
Figure 3:
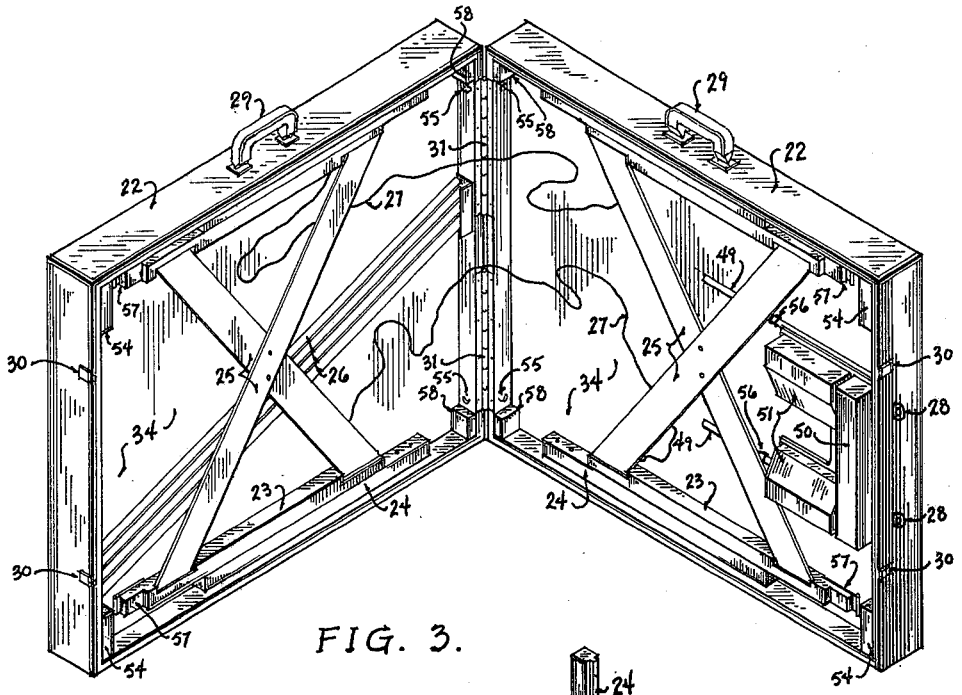
FIG. 3 is a perspective view in disassembled position, showing diagonal braces and face rest in storage position.
Figure 11:
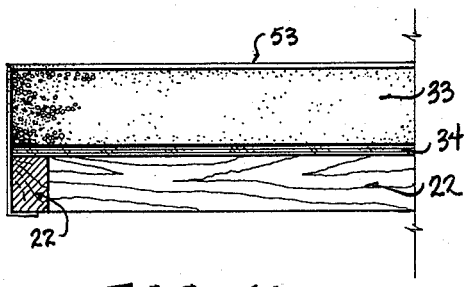
FIG. 11 is a sectional view of the table flange, flat surface, cushion and cover.

The massage and therapeutic body work table consists of a rectangular top illustrated at 20 in FIG. 1 formed by the abutment of two demi-sections 21, said demi-sections composed of a peripheral border flange 22 and surface element 34 of FIG. 3. Each demi-section may be fitted with a cushion 33 of FIG. 11 and an upholstery cover 53. The two demi-sections are attached together by a hinge means 31 of FIG. 3 along the juxtaposed border flanges, and may thus be folded to a parallel position for storage or transport as shown in FIG. 2. Latches 30 are provided to secure the demi-sections in parallel position and carrying handles 29 allow for ease in transport. For added strength, the inside corners of the peripheral flanges 22 are fitted with reinforcing members 54 and 58.

Figure 4:
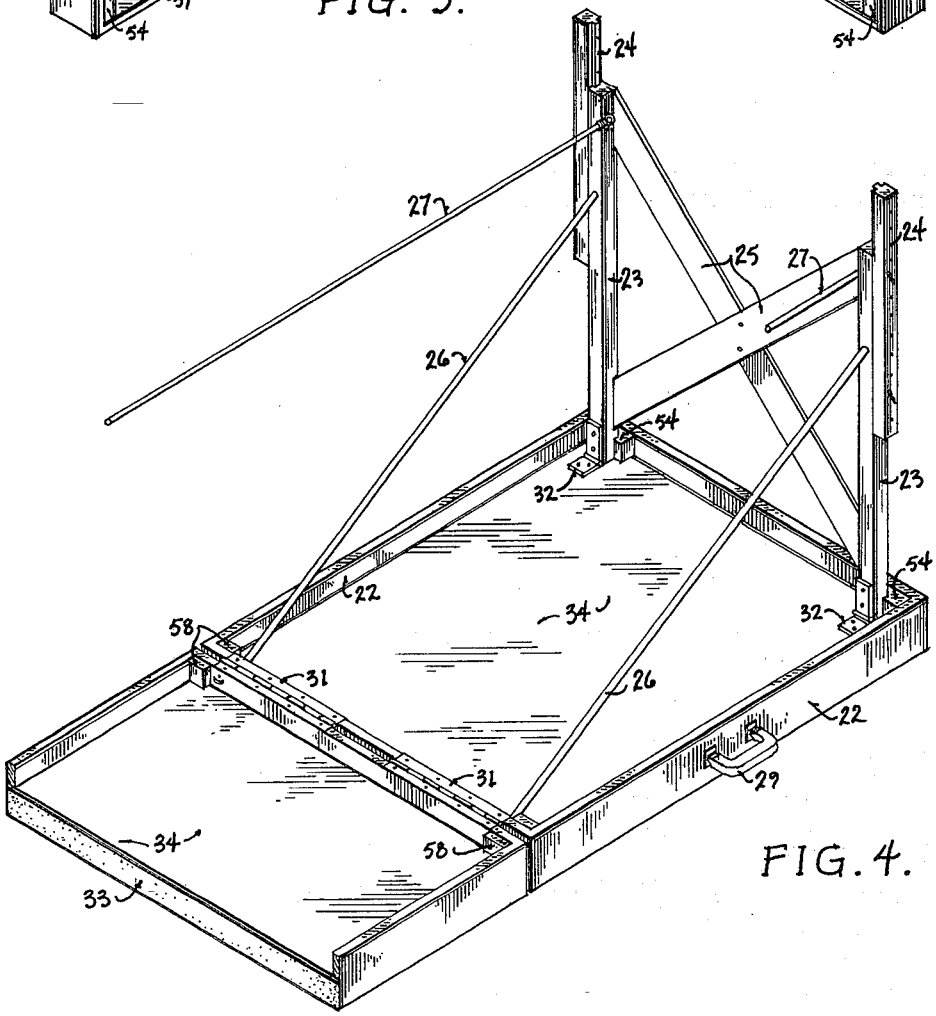
FIG. 4 is a perspective view of the undersurface of two-thirds of the table surface and one set of paired legs.

Two sets of paired legs as seen in FIG. 1 are attached to opposite ends of the table surface by hinge means 32 of FIG. 4 and are thus pivotal toward the demi-section undersurface and into the housing formed by the peripheral border flange 22 and surface element 34. Each leg is held in a parallel position to its paired member by means of a cross brace member 25 attached at the upper and lower ends of the paired legs preventing lateral movement.

Each leg consists of an upper leg member 23 attached to the table's surface by hinge means 32 and a lower leg member 24 attached to the outside surface of the upper leg member 23. The upper leg member surface opposite the hinged surface is provided with a lip 57. When the upper leg member is pivoted to an open or useable position as seen in FIG. 4, the lip 57 rests on reinforcing member 54 so as the reinforcing member 54 bears the major weight of the table. The upper leg member 23 is provided with a channel 41 along its outside surface and two threaded rods 43 installed through openings 44 from the inside to the outside surface of the upper leg members passing through the channel 41. The threaded rods 43 remain stationary in this position and are spaced near opposite ends of the upper leg member 23.

The lower leg member 24 is provided with a lip 40 for secure connection with channel 41. The lower leg member 24 is also provided with a plurality of aligned apertures 45 so as to allow attachment of the lower leg member 24 to the upper leg member 23 at higher and lower elevations. The lower leg member is further secured to the upper leg member 24 by installing adjusting nuts 46 to the threaded ends of rods 43.

Figure 5:
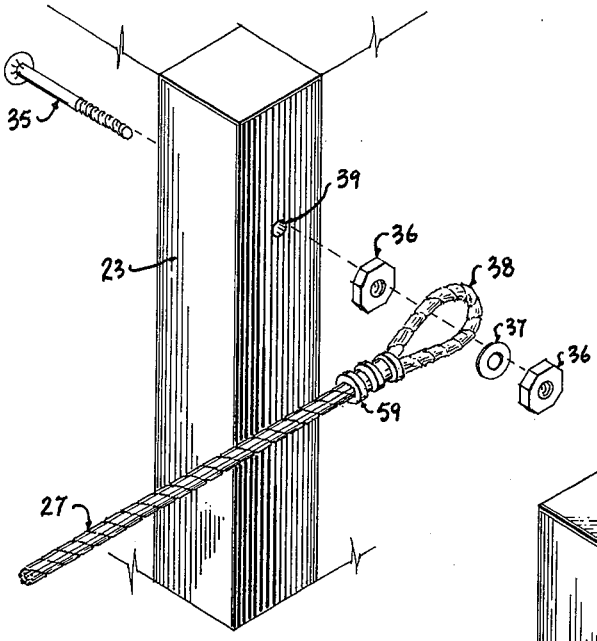
FIG. 5 is an enlarged, exploded view of the leg and chord member assembly.
Figure 6:
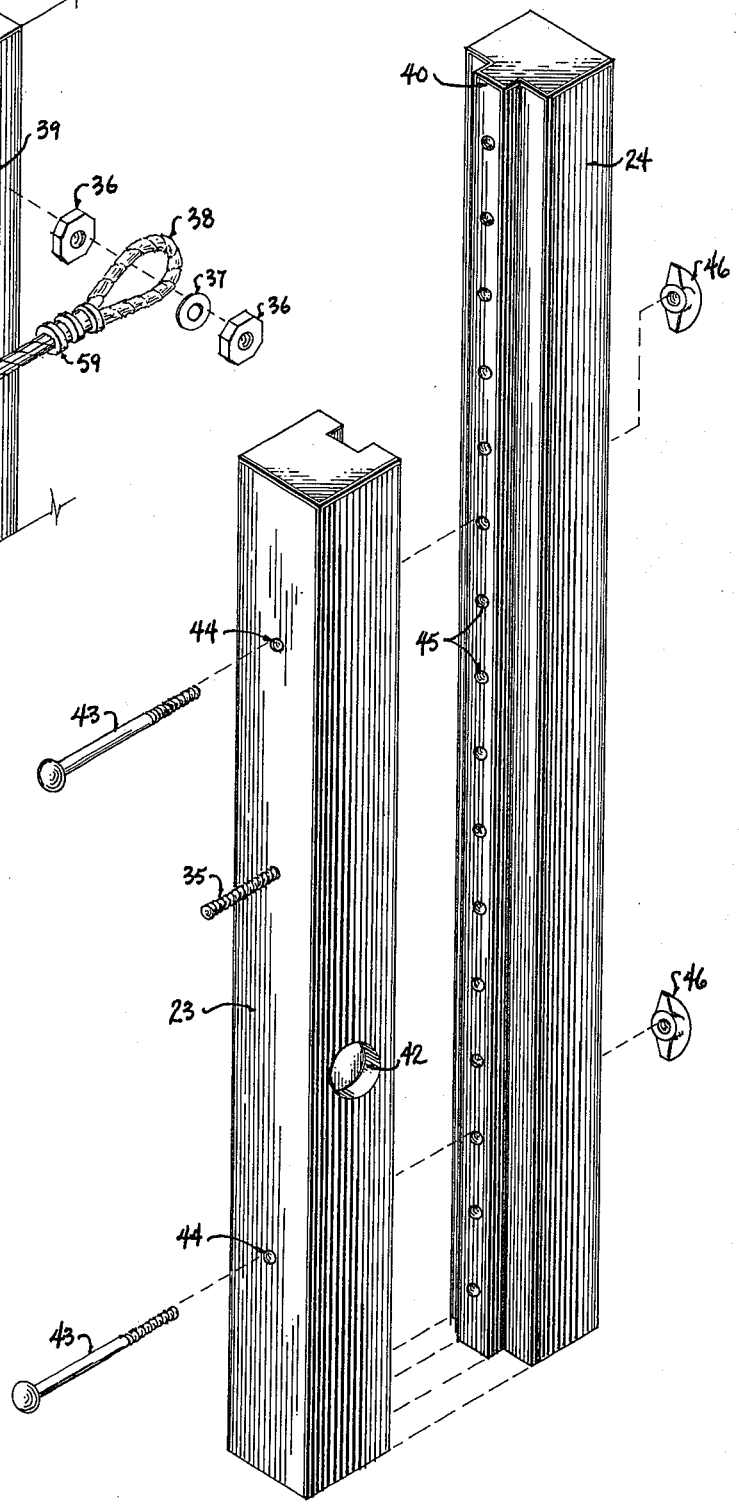
FIG. 6 is an enlarged, exploded view of the lower to upper leg assembly.
Figure 7:
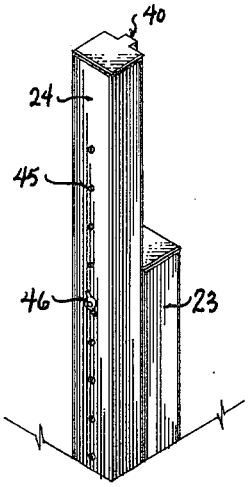
FIG. 7 is an enlargement of the lower to upper leg assembly from an outside perspective.
Figure 8:
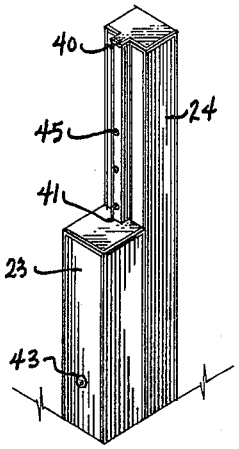
FIG. 8 is an enlargement of the lower to upper leg assembly from an inside perspective.
Figure 9:
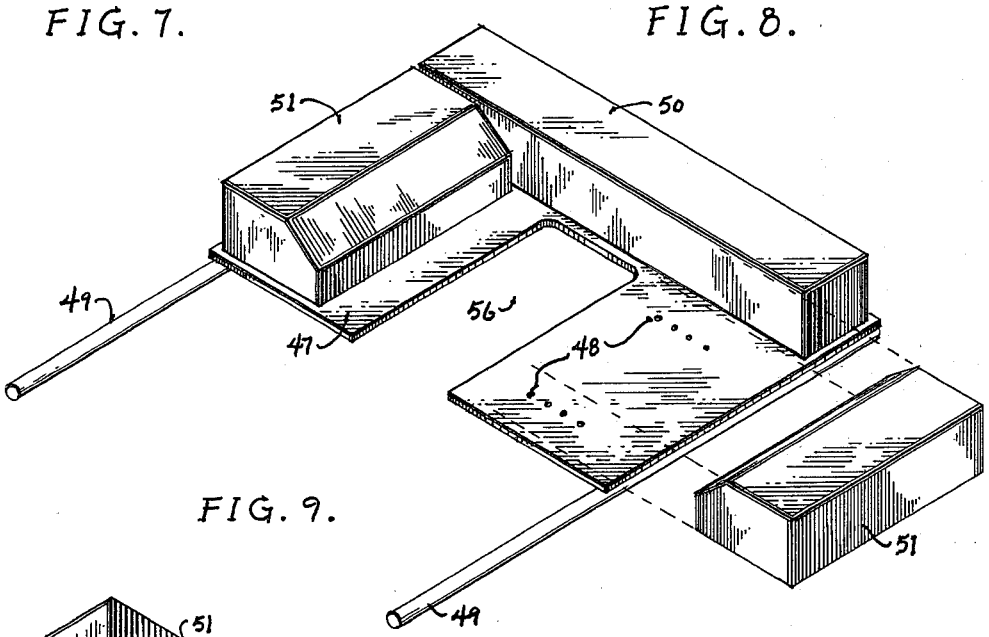
FIG. 9 is a blow up of the face rest.
Figure 10:
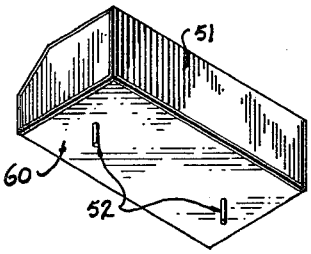
FIG. 10 is an enlargement of one face support piece from the face rest.

The truss support system consists of chord members 27 of wire rope or other flexible material attached to the lower ends of the upper leg members 23 as illustrated in FIG. 1, and extending the full length of the table parallel to the table surface 20. FIG. 5 shows in exploded form the means of attachment of the chord member 27 to the upper leg member 23 by means of a threaded rod 35 extending through the upper leg member 23 so that the nut 36, end loop of the chord member 38, flat washer 37 and nut 36 are all coaxial to said threaded rod 35. The loop of the chord member is secured by means of a collar 59 and held in co-axial position to threaded rod 35 by the flat washer 37. The chord members 27 are pivotal on said threaded rods 36, and their flexibility allows them to be folded into the table surfaces housing for storage as seen in FIG. 3.

The diagonal members of said truss support system consists of rods 26 or other rigid elements positioned between the upper leg members 23 and the flange 22 of the table's surface. For conversion of the table from a portable to a useable position, the diagonal members 26 are inserted into openings 42 on the surface of the upper leg members 23 and into openings 55 on the flange 22 of the abutting demi-sections. When converting from useable to portable position, the diagonals are removed and placed in storage position in the surface's housing as illustrated in FIG. 3.

The face rest is comprised of a rectangular supporting plate 47 mounted on two parallel rods 49 for insertion into openings 28 in the flange 22 at the end of the table's surface. A rectangular central section of the supporting plate 47 has been revolved leaving a rectangular opening 56 through which the nose and chin of the client may pass. A cushioned forehead piece 50 is attached to the supporting plate 47 and two cushioned face pieces 51 are provided. The undersurface 60 of the face pieces 51 are provided with two rods perpendicular to the undersurface which insert into aligning apertures 48 in the supporting plate 47 in parallel or slight diagonal position to each other. The face pieces may be positioned in close proximity or at a distance from each other according to the size of the client's face. When not in use the face rest is stored in the table's housing as shown in FIG. 3 by means of straps 56.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is:

1. A portable, folding massage table to be subjected to forces parallel to the surface thereof as well as vertical loading comprising:

a pair of rectangular table top sections;

a peripheral border flange depending from each of said sections;

hinge members interconnecting the flange bottom edges of adjacent sides of said sections to enable folding of said table top sections from a working configuration, wherein said table top sections are co-planar, and a portable configuration, wherein the bottom edges of said flanges are juxtaposed;

two pairs of support legs of rectangular cross section;

hinge means securing facing sides of each pair of legs to the underside of a table top section near the outer edge thereof to fold toward said hinge members into the receptacle formed by said border flange;

a pair of rigid, diagonal cross braces secured between the legs of each pair thereof;

a pair of flexible, non-stretchable cables, one of said cables being secured between each leg of a pair thereof and the opposing leg of the other pair thereof, each said cable being of nearly the combined lengths of said table top sections so as to be under tension when said sections are in working configuration, and being secured at opposite ends thereof to opposing legs near the bottoms thereof to prevent separation thereof;

a pair of rigid rods removably connected between the inner surface of each of said adjacent flanges near the ends thereof to said facing sides of the pair of legs carried on the same table top section to prevent inward movement thereof;

an extension for each of said legs;

a row of through holes along the length of each of said extensions;

a pair of spaced threaded members secured to each of said legs to extend from a lateral side thereof, said threaded members being receivable in a pair of said holes aligned therewith; and complementary tongue and groove slide means formed in said lateral side and a side of said extension containing said row of through holes.

2. The massage table defined by claim 1 wherein:

the outer side of each leg is cut away from the top thereof to form a transverse lip;

a pair of bearing blocks secured under each of said table top sections and positioned to be engaged by said transverse lips so that loads on said table top sections are transmitted to said legs through said bearing blocks and transverse lips.

3. The massage table defined by claim 1 including a head support comprising:

a flat base;

complementary slide and slideway on said base and one of said table top sections on the side opposite said adjacent side so that said base may be extended therefrom a selected distance;

a forehead support pad on said base along the outer edge thereof; and a pair of cheek support pads on said base generally parallel to the side edges thereof.

4. The massage table defined by claim 3 including:

complementary attaching means on said base and said cheek support pads enabling said cheek support pads to be positioned at adjusted settings.

5. The massage table defined by claim 4 wherein said attaching means comprises:

a pair of pins depending from at least one of said cheek support pads; and a series of pairs of holes to receive said pair of pins, said pairs of holes being spaced from a side edge of said based in varying distances.

6. The massage table defined by claim 1 including:

loops formed in the ends of said cables; and spindle members extending laterally from said support legs, said loops being carried over said spindles so that said cable ends are free for limited rotation during collapse of said table top sections but held under tension when said table top sections are in said working configurations.

* * * * *